US011147402B2

(12) United States Patent
Rubin et al.

(10) Patent No.: US 11,147,402 B2
(45) Date of Patent: Oct. 19, 2021

(54) DRINKING CONTAINER

(71) Applicant: GRACO CHILDREN'S PRODUCTS INC., Atlanta, GA (US)

(72) Inventors: Richard Rubin, Fairfield, NJ (US); Elliot Cohen, Jersey City, NJ (US)

(73) Assignee: GRACO CHILDREN'S PRODUCTS INC., Atlanta, GA (US)

( * ) Notice: Subject to any disclaimer, the term of this patent is extended or adjusted under 35 U.S.C. 154(b) by 176 days.

(21) Appl. No.: 15/692,758

(22) Filed: Aug. 31, 2017

(65) Prior Publication Data

US 2018/0055257 A1 Mar. 1, 2018

Related U.S. Application Data

(60) Provisional application No. 62/382,226, filed on Aug. 31, 2016.

(51) Int. Cl.

| | |
|---|---|
| ***A47G 19/22*** | (2006.01) |
| ***B65D 47/40*** | (2006.01) |
| ***B65D 47/04*** | (2006.01) |
| ***B65D 41/18*** | (2006.01) |
| ***B65D 25/40*** | (2006.01) |
| ***B65D 47/12*** | (2006.01) |

(Continued)

(52) U.S. Cl.

CPC ..... *A47G 19/2272* (2013.01); *B65D 25/40* (2013.01); *B65D 41/023* (2013.01);

(Continued)

(58) Field of Classification Search

CPC .... A47G 19/2272; B65D 47/40; B65D 47/04; B65D 47/06; B65D 47/127; B65D 47/128; B65D 41/023; B65D 41/025; B65D 41/165; B65D 41/16; B65D 41/265; B65D 41/185; B65D 41/18; B65D 43/0204; B65D 43/0208; B65D 43/065; B65D 43/06; B65D 43/021; B65D 2543/00555; B65D 2543/00046; B65D 2543/00518; B65D 2543/00592; B65D 2543/0062; B65D 2543/00629; B65D 2543/00648; B65D 2543/00731; B65D 2543/0074; B65D 2543/00472; B65D 2543/0049;

(Continued)

(56) References Cited

U.S. PATENT DOCUMENTS 3,165,227 A * 1/1965 Muoio ..... B65D 43/0218 220/800
3,189,071 A * 6/1965 Balkema ..... B65D 41/185 222/499

(Continued)

*Primary Examiner* — James N Smalley
*Assistant Examiner* — Jennifer Castriotta
(74) *Attorney, Agent, or Firm* — Evesheds Sutherland (US) LLP

(57) ABSTRACT

A drinking container is provided that can include a lid member and a cup member. The lid member can include a base member and a spout extending up from the base member. The spout can provide a fluid passageway from outside the drinking container to the volume of the cup member so that a child may drink liquid contained within the cup member. When the lid member is removably coupled to the cup member, two or more seals are created around the circumference of the drinking container between the lid member and the cup member to decrease the likelihood of leakage from between the cup member and the lid member when the lid is coupled to the cup member.

19 Claims, 2 Drawing Sheets

(51) Int. Cl.

| | |
|---|---|
| ***B65D 41/02*** | (2006.01) |
| ***B65D 43/02*** | (2006.01) |
| ***B65D 41/16*** | (2006.01) |
| ***B65D 47/06*** | (2006.01) |
| ***B65D 43/06*** | (2006.01) |
| ***A61J 11/00*** | (2006.01) |
| ***A61J 9/00*** | (2006.01) |

(52) U.S. Cl.
CPC ..... *B65D 41/165* (2013.01); *B65D 41/185* (2013.01); *B65D 43/0204* (2013.01); *B65D 43/0208* (2013.01); *B65D 43/065* (2013.01); *B65D 47/04* (2013.01); *B65D 47/06* (2013.01); *B65D 47/127* (2013.01); *B65D 47/40* (2013.01); *A61J 9/00* (2013.01); *A61J 11/0035* (2013.01)

(58) Field of Classification Search
CPC ..... B65D 2539/003; B65D 2547/04; B65D 2547/06; B65D 25/40; B65D 25/48; A61J 11/0035
USPC ..... 220/717, 790, 801; 215/355–364, 320, 215/247, 249
See application file for complete search history.

(56) References Cited

U.S. PATENT DOCUMENTS 3,216,610 A * 11/1965 Klygis ..... A47G 19/24 222/570
3,322,299 A * 5/1967 Foster ..... B65D 43/021 220/789
3,568,871 A * 3/1971 Livingstone ..... B65D 41/0421 215/344
3,672,528 A * 6/1972 Faulstich ..... B65D 43/0256 215/256
3,782,575 A * 1/1974 Braun ..... B65D 43/0208 215/211
3,817,420 A * 6/1974 Heisler ..... B65D 43/0208 220/790
3,910,444 A * 10/1975 Foster ..... B65D 43/021 215/295
4,308,970 A * 1/1982 Von Holdt ..... B29C 45/43 220/790
5,529,202 A * 6/1996 Shamis ..... A47G 19/2272 220/301
5,613,616 A * 3/1997 Monus ..... B65D 43/021 220/791
2003/0155365 A1* 8/2003 Llorente Lecue ... B65D 43/021 220/802
2003/0192891 A1* 10/2003 Ziegler ..... A47G 19/2272 220/288
2004/0245258 A1* 12/2004 Connors, Jr. ..... A47G 19/2272 220/713
2007/0175853 A1* 8/2007 Kebben ..... B65D 41/0414 215/344
2009/0014456 A1* 1/2009 Woinarski ..... B44D 3/127 220/790
2012/0247998 A1* 10/2012 Wahl ..... B65D 1/265 206/459.5
2017/0253363 A1* 9/2017 Feeley ..... A47G 19/02

* cited by examiner

DRINKING CONTAINER

RELATED APPLICATIONS

This application claims priority under 35 U.S.C. § 119 to U.S. Provisional Patent Application No. 62/382,226 filed Aug. 31, 2016, and titled "Drinking Container," the entire contents of which is hereby incorporated herein by reference for all purposes.

TECHNICAL FIELD

Embodiments disclosed herein are generally related to fluid containers, and more particularly to apparatuses and methods for a drinking container with lid.

BACKGROUND

Conventional drinking cups for children can include removable lids that help prevent large spills or leaks, especially when children are using the cups. These conventional lids are configured to be removable as needed, yet snugly fit to the upper rim of the cup to prevent leakage from the cup when used. These conventional lids can include drinking spouts or openings. Some conventional drinking spouts extend upward from the lid, while other openings may extend out from the lid or be positioned through the lid. The spouts and/or openings can include holes or slots so that when children place their mouths around or adjacent to the spout, they can receive fluids from inside the cup through the hole or slot(s), for example when the cup is tilted and/or inverted. Certain forms of these drinking cups for children are referred to as "sippy cups" or "training cups" (herein collectively referred to as "children's training cup" or "training cup".

Despite the lids being designed to snugly fit to the lids of the respective children's training cup, spills still occur. Conventional training cups only include one seal between the lid and the cup. Most often, the seal is provided between the upper rim of the cup and a recessed cavity that lines the circumference of the lid. If there are any deformities in either of the lid or the upper rim area of the cup, the single seal may be compromised and leaking can occur. Even without a defect in the lid or the upper rim area of the cup, this conventional cup and lid design that includes only one seal is still susceptible to leaks.

SUMMARY

The present disclosure relates to a drinking container that can provide two or more sealing areas (e.g., circumferential sealing area or sealing points, when viewed in cross-section) between a lid member and a cup member. The lid member can be removably coupled with the cup member. The lid member also can include a spout, similar to those described above, that extends up from a top surface of the lid member. The spout may include one or more holes, slots, or other apertures through which a child may be able to draw liquid from within the cup member. Drawing liquid from the cup member in this way may be limited to when the drinking container is tilted or inverted, or may be possible even when the drinking container is upright.

An upper end of the cup member (which may be shaped and sized in a number of ways) may include a first outward extending step wall extending horizontally or substantially horizontally in a radial direction away from the main side wall of the cup member. A first upper portion wall of the cup member may extend generally upwardly from the first outward extending step wall. Both the first outward extending step wall and the first upper portion wall of the cup member can extend around the circumference of the cup member. A second outward extending step wall can extend outwardly from the top end of the first upper portion wall of the cup member. The second outward extending step wall also can extend around a circumference of the cup member. At the intersection or joint between the first upper portion wall and the second outward extending step wall, a rib or flange member can extend inwardly (e.g. radially inwardly) toward the longitudinal axis of the cup. Additionally, a second ridge or flange member can extend upwardly from the top surface of the second outward extending step wall, and/or a depression, recess, or valley can extend concavely down into the top surface of the second outward extending step wall.

The lid member can include a first downward flange member that extends generally axially downwardly from a bottom surface of the lid member and can define an annular wall along the bottom of the lid member. An outward facing bulb member or protrusion can be positioned on the first downward flange member, and can be enlarged radially outwardly (toward the outside of the cup). The first downward flange member can be positioned at a pre-determined location that allows the bulb member or protrusion to slide along and subsequently abut the inward facing rib or flange member when the lid member and the cup member are selectively engaged with one another. Engaging the first downward flange member of the lid member with the inward facing rib or flange member of the cup member can cause the first downward flange member to deflect radially inwardly in order for the bulb member or protrusion to slide along and past the inward facing rib or flange member. Once the bulb member or protrusion has passed over the inward facing flange member, the first downward flange member resiliently returns to its resting state or to nearly it's resting state. The abutment between the bulb member or protrusion of the first downward flange member and the radially inward facing rib flange member of the cup member forms a first seal (e.g., a first circumferential seal) between the lid member and the cup member.

A second seal can also formed between the cup member and the lid member between a second downward flange member of the lid member, and the ridge or depression positioned along the second outward extending step wall of the cup member. The second downward flange member can extend generally axially downward from a bottom surface of the lid member and can define a second annular wall along the bottom of the lid member. The second downward flange member can be positioned radially outwardly from the first downward flange member. When the lid member and the cup member are removably coupled to one-another, the second downward flange member can abut the ridge and/or fits down into all or a portion of the recess or depression provided along the second outward extending step wall. This can create the second seal (e.g., the second circumferential seal) between the lid member and the cup member.

When the lid member is selectively removably coupled to the cup member, pressure exerted inwardly by the inward facing rib or flange member on the first downward flange can pull the second downward flange into a stronger abutment with the ridge and/or depression. Similarly, pressure exerted outwardly by the ridge and/or depression on the second downward flange, can pull the first downward flange member into a stronger abutment with the inward facing rib or flange member and the first upper portion wall. This can increase the seal strength of each of the first and second circumferential seals between the lid member and cup member.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION OF THE EXAMPLE EMBODIMENTS

Figure 1:
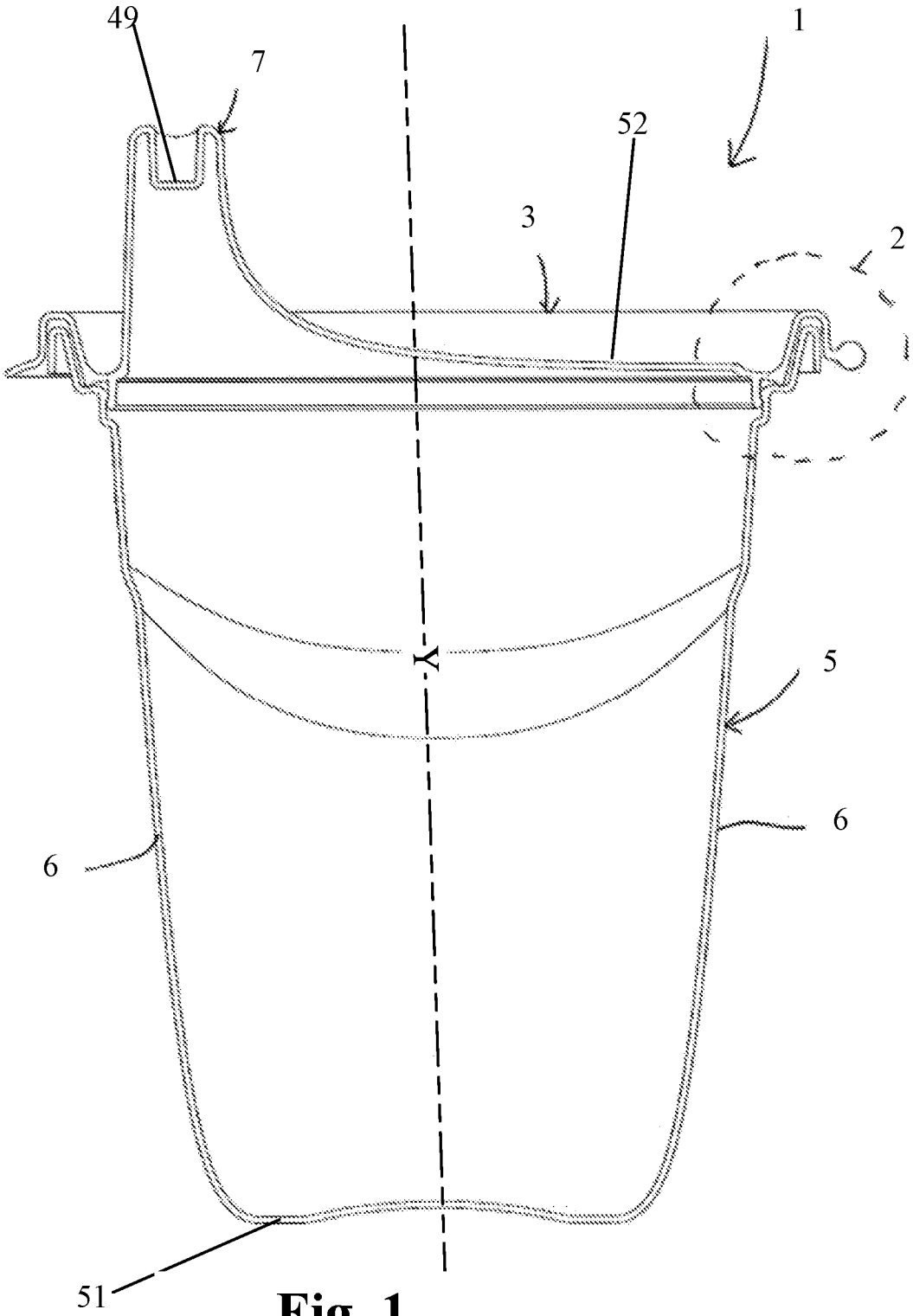
FIG. 1 is a cross-section view of a drinking container in accordance with one example embodiment of the disclosure.

Example embodiments will now be described more fully hereinafter with reference to the accompanying drawings, in which example embodiments are shown. The concepts disclosed herein may, however, be embodied in many different forms and should not be construed as limited to the example embodiments set forth herein; rather, these embodiments are provided so that this disclosure will be thorough and complete, and will fully convey the scope of the concepts to those skilled in the art. Like numbers refer to like, but not necessarily the same or identical, elements throughout.

Certain dimensions and features of the example drink container are described herein using the term "approximately." As used herein, the term "approximately" indicates that each of the described dimensions is not a strict boundary or parameter and does not exclude functionally similar variations therefrom. Unless context or the description indicates otherwise, the use of the term "approximately" in connection with a numerical parameter indicates that the numerical parameter includes variations that, using mathematical and industrial principles accepted in the art (e.g., rounding, measurement or other systematic errors, manufacturing tolerances, etc.), would not vary the least significant digit.

In addition, certain relationships between dimensions of the drink container lid and between features of the drink container are described herein using the term "substantially." As used herein, the terms "substantially" and "substantially equal" indicates that the equal relationship is not a strict relationship and does not exclude functionally similar variations therefrom. Unless context or the description indicates otherwise, the use of the term "substantially" or "substantially equal" in connection with two or more described dimensions indicates that the equal relationship between the dimensions includes variations that, using mathematical and industrial principles accepted in the art (e.g., rounding, measurement or other systematic errors, manufacturing tolerances, etc.), would not vary the least significant digit of the dimensions. As used herein, the term "substantially constant" indicates that the constant relationship is not a strict relationship and does not exclude functionally similar variations therefrom. As used herein, the term "substantially parallel" indicates that the parallel relationship is not a strict relationship and does not exclude functionally similar variations therefrom. As used herein, the term "substantially vertical" indicates that the vertical positioning is not strictly limited to perfectly vertical positioning and does not exclude functionally similar variations therefrom. As used herein, the term "substantially horizontal" indicates that the horizontal positioning is not strictly limited to perfectly horizontal positioning and does not exclude functionally similar variations therefrom. As used here, the term "substantially radial" and "substantially radially" indicates that the radial aspect of a feature is not strictly limited and does not exclude functionally similar variations therefrom. As used herein, the term "substantially orthogonal" indicates that the perpendicular relationship is not a strict relationship and does not exclude functionally similar variations therefrom.

FIG. 1 is a cross-sectional view of a drinking container 1, in accordance with one example embodiment of the disclosure. Referring now to FIG. 1, the drinking container 1 can include a lid member 3 and a cup member 5. The lid member 3 is configured to be selectively coupled to and decoupled from the cup member 5 (as described in detail herein below).

The cup member 5 can include a bottom surface 51 and one or more side walls 6 extending generally up from the bottom surface 51. In certain example embodiments, the bottom surface 51 can have a generally circular shape or outer perimeter shape. In other example embodiments, the bottom surface 51 can have any other shape including, but not limited to, oval, square, rectangular, another multi-sided geometric shape, or the like.

In one example embodiment, the cup member 5 has a single side wall 6 that extends up from the bottom surface 51 and has a generally circular cross-sectional shape along an axis orthogonal to the vertical axis. In certain example embodiments, the one or more side walls 6 of the cup member 5 can extend vertically or substantially vertically upward, can taper inwardly from top to bottom, can taper outwardly from top to bottom, or any combination thereof. Tapering of the side walls 6 may make the cup member 5 easier for a child to grasp. Other shapes for the cup member 5 are also envisioned herein as would be understood in the art.

The lid member 3 may include a base having a top surface 52 and a bottom surface 53. The lid member 3 can further include a spout 7 extending upwardly from a top surface 52 of the lid member 3 therefrom and integrally formed with the lid member 3. The spout 7 may include one or more holes, slots, or other apertures 49 that, with the spout 7, provide a fluid passageway through which a user, such as a child, may be able to draw liquid from within the cup member 5.

Figure 2:
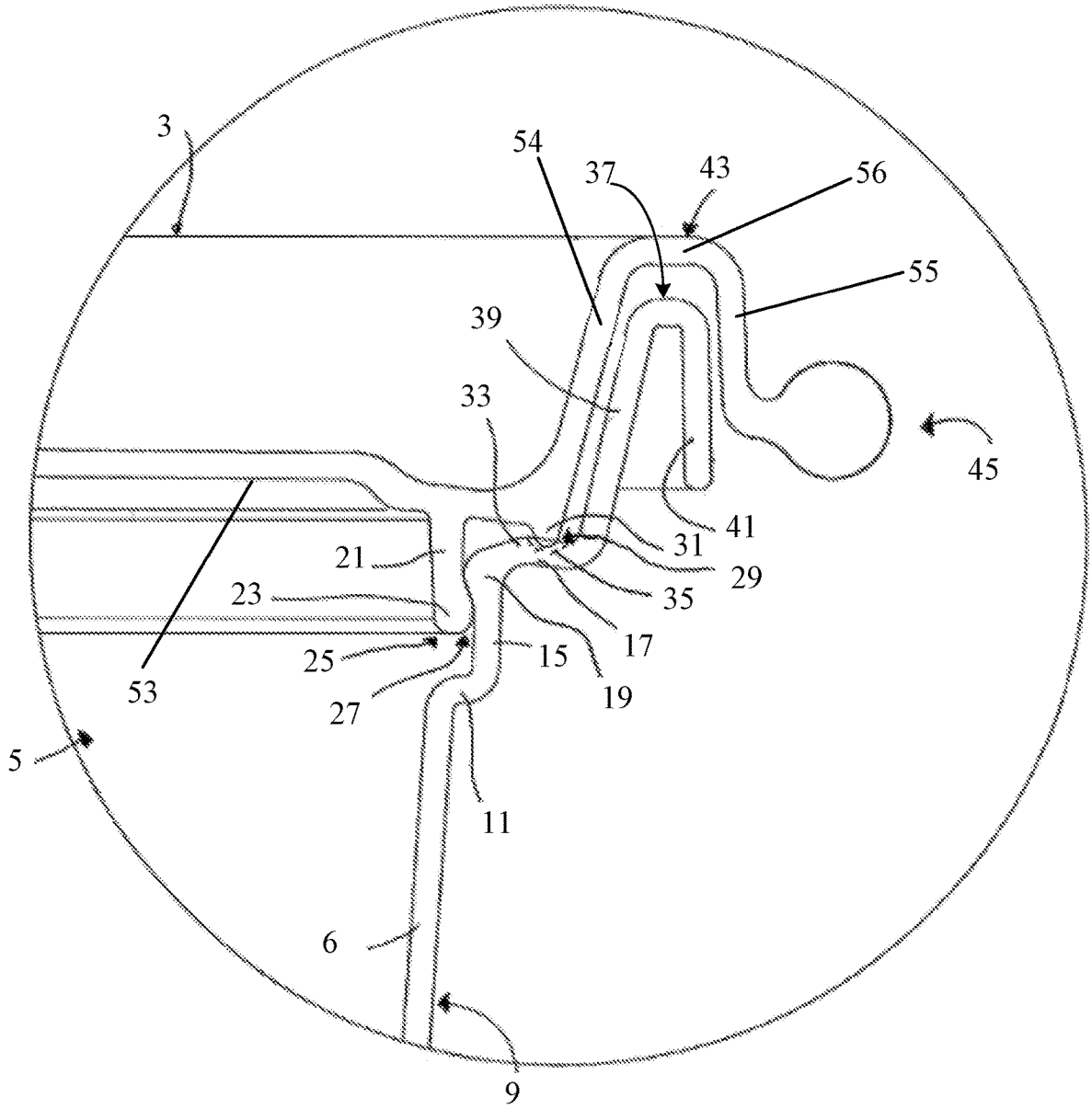
FIG. 2 is a partial cross-sectional view of a portion of an attachment between a cup member and lid member of the drinking container of FIG. 1, in accordance with one example embodiment of the disclosure.

FIG. 2 is a partial cross-sectional view of a portion of an attachment between the cup member 5 and the lid member 3 of the drinking container 1 of FIG. 1, in accordance with one example embodiment of the disclosure. Referring now to FIGS. 1 and 2, the enlarged view more closely illustrates the structure of an upper end 9 of the one or more side walls 6 of the cup member 5. The upper end 9 of each of the one or more side walls 6 can include a first outward extending step wall 11 that extends horizontally or substantially horizontally outward away from the central longitudinal axis Y in a radial direction and away from an upper end 9 of the side wall 6, in one example embodiment. The first outward extending step wall 11 can have a first end coupled to or integrally formed with and extending from upper end of the side wall 6 and a distal second end. In other example embodiments, the first outward extending step wall 11 may extend outwardly away from the central longitudinal axis Y of the cup member 5 with an incline or decline relative to the horizontal. In one example embodiment, the angle of incline or decline from the horizontal can be anywhere in the range of substantially 0 degrees to substantially 45 degrees and more preferably substantially 0 degrees to substantially 20 degrees.

Each of the one or more side walls 6 of the cup member 5 can also include a first upper portion wall 15. The first upper portion wall 15 can include a first end coupled to or integrally formed with the second end of the first outward extending step wall 11 and a distal second end. In one example, the first upper portion wall 15 extends generally upwardly from the first outward extending step wall 11 in a vertical or substantially vertical direction from the second end of the first outward extending step wall 11. In other example embodiments, the first upper portion wall 15 can be tapered inwardly or outwardly from the first end to the second end of the first upper portion wall 15 with respect to a vertical axis.

Each of the first outward extending step wall 11 and the first upper portion wall 15 of the cup member 5 may extend around the circumference of the cup member 5. Further, the upper end 9 of each of the one or more side walls 6, the first outward extending step wall 11, and the first upper portion wall 15 can together define a top surface along the top edge of the first outward extending step wall 11 that is horizontal or substantially horizontal and extends along a horizontal or substantially horizontal axis to create a flat or substantially flat surface.

The first upper portion wall 15 has an inner circumference defined by its inwardly facing surface as it extends around the cup member 5 that is larger than the inner circumference of the inwardly facing surface of the one or more side walls 6 at a point immediately below an intersection of the one or more side walls 6 and the first outward extending step wall 11. Because the first upper portion wall 15 has an inner circumference larger than the inner circumference of the one or more side walls 6 at the point immediately below the intersection of the one or more side walls 6 and the first outward extending step wall 11, the cup member 5 is provided with a somewhat increased volume at the first upper portion wall 15 than if the first upper portion wall 15 had an inner circumference equal to the upper end 9 of the one or more sides 6 at the point immediately below the intersection of the one or more side walls 6 and the first outward extending step wall 11.

As shown in FIG. 2, the first upper portion wall 15 may extend at an angle that is parallel or substantially parallel to the angle of the one or more side walls 6 of the cup member 5. In one example embodiment, the angle can be anywhere within the range of substantially 80 to substantially 110 degrees from a horizontal axis. In alternative embodiments, the first upper portion wall 15 may have an angle different than the angle of the one or more side walls 6 and can be somewhat angled inwardly or outwardly relative to the angle of extension of the one or more side walls 6 of the cup member 5.

The cup member 5 can also include a second outward extending step wall 17 that extends horizontally or substantially horizontally outward in a radial direction away from the central longitudinal axis Y, in one example embodiment. The second outward extending step wall 17 can have a first end coupled to or integrally formed with and extending outward from the second end of the first upper portion wall 15 and a distal second end. In other example embodiments, the second outward extending step wall 17 may extend outwardly with an incline or decline to the horizontal. In certain example embodiments, the angle of extension of the first outward extending step wall 11 is parallel or substantially parallel to the angle of extension of the second outward extending step wall 17.

The second outward extending step wall 17, like the first outward extending step wall 11, extends around the circumference of the cup member 5. In certain example embodiments, the second outward extending step wall 17 increases the circumference of this portion of the cup member 5 relative to the first upper portion wall 15 and the upper end of the one or more side walls 6 of the cup member 5. In alternative embodiments, the second outward extending step wall 17 may extend outwardly from the second end of the first upper wall portion 15 in an inclined or declined direction relative to the horizontal. In one example embodiment, the angle of incline or decline from the horizontal can be anywhere in the range of substantially 0 degrees to substantially 45 degrees and more preferably substantially 0 degrees to substantially 20 degrees.

The cup member 5, can also include a radially inwardly extending circumferential rib or flange member 19 that extends inwardly (toward the longitudinal axis Y) from the second end of the first upper portion wall 15 adjacent to the intersection between the first upper portion wall 15 and the second outward extending step wall 17. The rib or flange member 19 can extend circumferentially along the inner circumference of the first upper portion wall 15. The radially inwardly extending rib or flange member 19 may have a rounded inner facing wall (the wall closest to the longitudinal axis Y), or may be any other suitable shape as would be understood by those of ordinary skill in the art. The example rib or flange member 19 creates a smaller inner circumference at the inner wall of the rib or flange member 19 than the inner circumference of the inner surface of the rest of the first upper portion wall 15 of the cup member 5.

FIG. 2 also illustrates a portion of the lid member 3 in greater detail. As shown in FIG. 2, the lid member 3 can further include a first downward flange member 21 that extends downwardly in a vertical or substantially vertical direction from a bottom surface 53 of the lid member 3. The first downward flange member 21 can include a first end and a distal free end. The first end of the first downward flange member 21 can be coupled to or integrally formed with the bottom surface 53 of the lid member 3. In one example, the first downward flange member 21 defines an annular ring or wall that extends axially down from the bottom surface 53 and extends circumferentially along the bottom surface 53 of the lid member 3 in a circular or substantially circular manner. Alternatively, multiple first downward flange members 21 may be provided along the bottom surface 53 of the lid member 3, each first downward flange member 21 being a discrete flange that that extends axially down from the bottom surface 53 but is not continuously extending circumferentially along the bottom surface 53 of the lid member 3. The multiple first downward flange members 21 may be positioned equidistantly or randomly along a circumferential path along the bottom surface 53 of the lid member 3. In one example, the first downward flange member 21 is integrally formed with the lid member 3.

In some example embodiments, an outward facing bulb member or protrusion 23 is provided along a radially exterior-facing side of the free end of the first downward flange member 21. The example outward facing bulb member or protrusion 23 can be integrally formed with the first downward flange member 21 and causes the free end of the first downward flange member 21 or a portion adjacent thereto to have a greater width than the remainder of the member 21 and to be enlarged radially outwardly (toward the outer perimeter of the lid member 3) that creates a larger outer circumference along the part of the member 21 having the bulb member or protrusion 23 than the rest of the first downward flange member 21. In certain example embodiments, the first downward flange member 21 can be positioned at a pre-determined location along the bottom surface 53 of the lid member 3 that allows the bulb member or protrusion 23 of the first downward flange member 21 to slide along an interior side of and subsequently abut the radially inwardly extending rib 19 of the cup member 5 when the lid member 3 and the cup member 5 are removably coupled to one another. When the lid member 3 engages with the cup member 5 as they are being removably coupled to one-another, at least a portion of the flange member 21 deflects radially or substantially radially inwardly in order for the bulb member or protrusion 23 to slide along and past the inward extending rib or flange member 19. Once the bulb member or protrusion 23 has been slid passed the rib or flange member 19, the first downward flange member 21 resiliently returns to its resting state or to nearly it's resting state as will be discussed below.

As shown in FIG. 2, when the outward facing bulb member or protrusion 23 abuts the inwardly extending rib or flange member 19, a first seal 27 (e.g., a first circumferential seal) is formed between the bulb member or protrusion 23 of the first downward flange member 21 and the radially inwardly extending rib or flange member 19 of the cup member 5. The first seal 27 is configured to act as a fluid seal between the lid member 3 and the cup member 5 to help to retain liquid within the cup member 5 and prevent leaks and/or spills. The resiliency or spring-biasing force of the first downward flange member 21 and the positioning of the bulb member or protrusion 23 below or immediately below the radially inwardly extending rib or flange member 19 to contact the first upper portion 15 below or immediately below the rib or flange member 19, allows the first seal 27 to resist removal of the lid member 3 from the cup member 5

A second seal 29 (e.g., a second circumferential seal) can also be formed between the cup member 5 and the lid member 3. For example, the lid member 3 can include a second downward flange member 31 extending downwardly in a vertical or substantially vertical direction from the bottom surface 53 of the lid member. The second downward flange member 31 can include a first end and a distal free end. The first end of the second downward flange member 31 can be coupled to or integrally formed with the bottom surface 53 of the lid member 3. In one example, the second downward flange member 31 defines an annular ring or wall that extends axially down from the bottom surface 53 and extends circumferentially along the bottom surface 53 of the lid member 3 in a circular or substantially circular manner. As shown in FIG. 2, the second downward flange member 31 may be positioned radially outwardly from the first downward flange member 21 along the bottom surface 53 of the lid member 3. The second downward flange member 31 may not extend as far downwardly as the first downward flange member 21 (e.g., the axial length of the second downward flange member 31 can be shorter than the axial length of the first downward flange member 21), as is shown in FIG. 2. In some alternative example embodiments, rather than a single annular ring, multiple second downward flange members 31 may be provided along a circular path, wherein each of the second downward flange members 31 may be a discrete flange member that does not encircle the lid member 3.

To engage with the second downward flange member 31, the second outward extending step wall 17 may include a ridge 33 and/or a depression 35 disposed along its top surface and provided around its full circumference or in discrete locations. While the second outward extending step wall 17 can include a substantially flat and/or horizontal top surface, the ridge 33 can extend to a height above the remainder of the substantially flat top surface (similar to a bump or hill) of the second outward extending step wall 17. In examples where a depression 35 is provided, the depression 35 can be a recess or indentation along the substantially flat and/or horizontal top surface that extends below the level of the substantially flat and/or horizontal top surface of the second outward extending step wall 17.

The second downward flange member 31 may be positioned and located on the lid member 3 to abut the ridge 33 and/or fit down into the depression 35 of the second outward extending step wall 17 when the lid member 3 is removably coupled to the cup member 5. When the second downward flange member 31 and the ridge 33 and/or depression 35 abut one another, as shown in FIG. 2, a second seal 29 between the cup member 5 and the lid member 3 is created.

As noted above, when the lid member 3 is removably coupled to the cup member 5, the rib or flange member 19 may press inwardly on the first downward flange member 21, and/or the first upper portion wall 15 may press inwardly on the bulb member or protrusion 23. As a result, the first downward flange member 21 applies a radially outward force on the first upper portion wall 15 and/or rib or flange member 19 of the cup member 5, and the first upper portion wall 15 and/or the radially inward extending rib or flange member 19 of the cup member 5 applies a radially inward force on the free end of the first downward flange member 21. At the same time, the second downward flange member 31 applies at least a partially radially inward force on the ridge 33 and/or depression 35, and the ridge 33 or depression applies a radially outward force on the free end of the second downward flange member 31.

Thus, when the lid member 3 is removably coupled with the cup member 5, the first downward flange member 21 and the second downward flange member 31 can provide biasing forces against one another in opposite radial directions. For example, as the first downward flange 21 is forced radially inwardly, it pulls the second downward flange 31 into a stronger abutment with the ridge 33 and/or depression 35. Similarly, as the ridge 33 and/or depression 35 exert radially outward pressure on the second downward flange 31, the first downward flange member 21 is pulled into a stronger abutment with the radially inwardly extending rib or flange member 19 and first upper portion wall 15. This can increase the seal strength of each of the first and second seals 27, 29, and otherwise more securely couples the lid member 3 to the cup member 5.

As will be understood, the structure by which the remainder of lid member 3 and cup member 5 engage may take many forms. As shown in FIG. 2, the cup member 5 can further include a rim 37 that extends generally upward from the second end (e.g., radially outer edge) of the second outward extending step wall 17 and extends substantially around the circumference of the cup member 5 at a top portion thereof. The rim 37 may include each of an inner wall 39 and an outer wall 41 coupled or integrally formed with one-another. The inner wall 39 can include a first end coupled to the second outward extending step wall 17 and can extend generally upwardly to a second end. The outer wall 41 can include a first end coupled to and positioned radially outward from the second end of the inner wall 39 and can extend generally downward from the first end of the outer wall 41 to a second distal free end.

The lid member 3 is also provided with a corresponding rim 43 that is shaped substantially similarly to the rim 37 of the cup member 5. Like the rim 37 of the cup member 5, the rim 43 of the lid member may extend around the entirety of the circumference of the lid member 3. Further, the rim 43 can include each of an inner wall 54 and an outer wall 55 positioned radially outward from the inner wall 54. The inner wall 54 and outer wall 55 can be coupled to each other or the rim 43 can further include a top wall 56 extending between the inner wall 54 and the outer wall 55. The inner wall 54 can include a first end coupled to the top surface 52 of the lid member 3 and can extend generally upwardly from there to a second end. The outer wall 55 can include a first end coupled to and positioned radially outward from the second end of the inner wall 54 and can extend generally downward from the first end of the outer wall 55 to a second distal end. Alternatively, the top wall 56 can include a first end coupled to the second end of the inner wall 54 and a distal second end coupled to the first end of the outer wall 55. As shown in FIG. 2, when the lid member 3 and the cup member 5 are removably coupled to one another, the rims 37, 43 may but do not necessarily abut one another and can provide a third seal (e.g. a third circumferential seal) between the lid member 3 and the cup member 5.

As shown in FIG. 2, the lid member 3 may also include a rounded tab hinge 45. The rounded tab hinge 45 may extend outwardly away from the rim 43 and radially outward from the outer wall 55. The rounded tab hinge 45 may extend around all or a portion of the circumference of the lid member 3 and may provide a gripping area by which a user can grip the lid member 3 to hingedly couple and decouple the lid member 3 from the cup member 5, as will be understood to those of ordinary skill in the art. In an alternative embodiment, the rounded tab hinge 45 may be excluded.

Though the disclosed example includes a particular arrangement of a number of parts, components, features, and aspects, the disclosure is not limited to only that example or arrangement. Any one or more of the parts, components, features, and aspects of the disclosure can be employed alone or in other arrangements of any two or more of the same.

Although certain drink container features, functions, components, and parts have been described herein in accordance with the teachings of the present disclosure, the scope of coverage of this patent is not limited thereto. On the contrary, this patent covers all embodiments of the teachings of the disclosure that fairly fall within the scope of permissible equivalents.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

What is claimed is:

1. A drinking container comprising:

a cup member, comprising:

a bottom wall;

a side wall extending up from the bottom wall;

a first rib extending radially inward from the side wall; and at least one of a ridge and a recess disposed in an interior surface of the side wall;

a lid member removably coupled to the cup member, the lid member comprising:

a base member;

a first flange member extending down from the base member and comprising a first protrusion; and a second flange member disposed radially outward of the first flange member, extending down from the base member, and comprising a free end, wherein the first rib abuts the first protrusion and the free end of the second flange member abuts the at least one of the ridge and the recess within the interior volume of the cup member.

2. The drinking container of claim 1, wherein the first rib extends around a first circumference of the cup member and the first protrusion extends around a first circumference of the lid member, wherein contact between the first rib and the first protrusion creates a first seal between the cup member and the lid member.

3. The drinking container of claim 2, wherein the free end of the second flange member extends around a second circumference of the lid member that is greater than the first circumference of the lid member.

4. The drinking container of claim 3, wherein the free end of the second flange member abutting the at least one of the ridge or recess creates a second seal between the cup member and the lid member.

5. The drinking container of claim 1, wherein the first protrusion is disposed along a free end of the first flange member and extends radially outward from the first flange member.

6. The drinking container of claim 1, wherein the first flange member is a resilient member and wherein the first rib is configured to generate a radially inward force against the first protrusion.

7. The drinking container of claim 6, wherein the side wall further comprises:

a first circumference at an upper end of the side wall;

a first outward extending step wall comprising a first end extending radially outward from the upper end of the side wall and a distal second end;

a first upper portion wall comprising a first wall end extending upward from the second end of the first outward extending step wall to a second wall end, the first upper portion wall comprising the first rib and a second circumference greater than the first circumference; and a second outward extending step wall comprising a first end extending radially outward from the second wall end of the first upper portion wall to a distal second end of the second outward extending step wall, wherein said second outward extending step wall comprises the at least one of a ridge or recess.

8. The drinking container of claim 7, wherein the cup member further comprises a first rim comprising an inner wall and an outer wall, and wherein the first rim extends upward from the distal second end of the second outward extending step wall.

9. The drinking container of claim 8, wherein the lid member further comprises a second rim comprising an inner and outer wall, and wherein the second rim has a corresponding shape to the first rim of the cup member.

10. The drinking container of claim 9, wherein the inner wall of the first rim contacts the inner wall of the second rim, and wherein the outer wall of the first rim contacts the outer wall of the second rim.

11. The drinking container of claim 1, wherein the first rib is configured to generate a radially inward force on the first protrusion.

12. A lid for a drinking container comprising:

a base member comprising a top surface and an opposing bottom surface;

a spout extending upwards from the top surface of the base member;

a first flange member extending down from the bottom surface of the base member and comprising a first protrusion;

a second flange member disposed radially outward of the first flange member, extending down from the bottom surface of the base member, and comprising a free end; and a rim comprising an outer wall, wherein the outer wall of the rim is disposed radially outward of the first flange member and the second flange member.

13. The lid of claim 12, wherein the first flange member defines a first annular wall, wherein the first protrusion extends about the first circumference of the first annular wall and wherein the second flange member defines a second annular wall, wherein the free end of the second flange member extends about the second circumference of the second annular wall.

14. The lid of claim 12, wherein the first protrusion and the free end of the second flange member comprise discrete flanges that do not continuously extend around the circumference of the lid.

15. A cup for a drinking container comprising:

a bottom wall;

a side wall extending up from the bottom wall;

a first outward extending step wall comprising a first end extending radially outward from the upper end of the side wall and a distal second end;

a first upper portion wall comprising a first wall end and a distal second wall end, the first wall end extending upward from the second end of the first outward extending step wall to the second wall end, the first upper portion wall comprising:

a first rib extending radially inward from the first upper portion wall; and a second outward extending step wall comprising a first end extending radially outward from the second wall end of the first upper portion wall to a distal second end of the second outward extending step wall, the second outward extending step wall comprising:

a substantially flat and horizontal top surface;

a ridge extending up from a portion of the substantially flat and horizontal top surface of the second outward extending step wall.

16. The cup of claim 15, wherein the first rib is positioned adjacent to the second wall end of the first upper portion wall.

17. The cup of claim 15, wherein the side wall comprises a first inner circumference and the first upper portion wall has a second inner circumference and wherein the first inner circumference is less than the second inner circumference.

18. The cup of claim 15, wherein the first outward extending step wall and the second outward extending step wall are substantially parallel.

19. The cup of claim 15, wherein the first outward extending step wall has a first radial length and the second outward extending step wall has a second radial length, wherein the second radial length is greater than the first radial length.

* * * * *